US008076603B2

(12) United States Patent
Huang et al.

(10) Patent No.: US 8,076,603 B2
(45) Date of Patent: Dec. 13, 2011

(54) AXIALLY-MOVABLE ROTARY SWITCH

(75) Inventors: Chen-Hong Huang, Taoyuan (TW); Ta-Feng Yeh, Taoyuan (TW)

(73) Assignee: Solteam Electronics Co., Ltd., Taoyuan (TW)

( * ) Notice: Subject to any disclaimer, the term of this patent is extended or adjusted under 35 U.S.C. 154(b) by 504 days.

(21) Appl. No.: 12/401,070

(22) Filed: Mar. 10, 2009

(65) Prior Publication Data

US 2010/0147665 A1 Jun. 17, 2010

(30) Foreign Application Priority Data

Dec. 17, 2008 (TW) ..... 97222612 U

(51) Int. Cl.
*H01H 13/62* (2006.01)
*H01H 19/14* (2006.01)

(52) U.S. Cl. ..... 200/566; 200/572; 200/50.36; 200/336; 200/342

(58) Field of Classification Search ..... 200/565–572, 200/336, 5 E, 50.36, 341–342
See application file for complete search history.

(56) References Cited

U.S. PATENT DOCUMENTS 5,469,125 A * 11/1995 Shigemoto et al. ..... 338/162
5,680,927 A * 10/1997 Thornton ..... 200/565
5,771,878 A * 6/1998 Lewis et al. ..... 126/42
7,629,549 B2 * 12/2009 Huang et al. ..... 200/568

FOREIGN PATENT DOCUMENTS

JP 06068750 A * 3/1994

* cited by examiner

*Primary Examiner* — Felix O Figueroa

(57) ABSTRACT

An axially-movable rotary switch includes a casing, a fixing base, a substrate and a knob. The fixing base is fixed in the hollow casing. The substrate is fixed below the fixing base. The knob is pivotally disposed on the upper end of the hollow casing. The switching rod of the knob eccentrically penetrates a positioning hole of the fixing base. The elastic piece is disposed at the distal end of the switching rod and is brought into contact with the electrical contacts of the substrate. With the elastic piece of the switching rod being arranged to correspond to the electrical contacts of the substrate, a user can switch the states between a closed circuit and an open circuit by axially drawing/pressing the knob. Further, the contact between the elastic piece and the electrical contacts will not generate unnecessary frictional interference, so that the lifetime of the device can be extended.

13 Claims, 6 Drawing Sheets

AXIALLY-MOVABLE ROTARY SWITCH

CROSS-REFERENCE TO RELATED APPLICATION

This application claims priority under 35 U.S.C. §119 to Taiwan Patent Application No. 097222612, filed on Dec. 17, 2008, in the Taiwan Intellectual Property Office, the entire contents of which are hereby incorporated by reference.

BACKGROUND OF THE INVENTION

1. Field of the Invention

The present invention relates to an axially-movable rotary switch, and in particular to an axially-movable rotary switch in which a closed circuit and an open circuit can be switched.

2. Description of Related Art

The state of an electronic device is usually changed by means of a switch. The most common switch is a two-stage switch for changing between a closed circuit and an open circuit. This kind of switch is operated by means of pressing or pushing. The press switch engages with an elastic piece, so that the elastic force of the elastic piece is used to switch states between a closed circuit and an open circuit. In the push switch, two electrodes are electrically connected or disconnected via a pushing and sliding action.

However, the conventional switch has the drawback of large occurring friction. Since the switch of an electronic device may have to generate switching actions very frequently, the elastic piece and electrodes may become worn down from friction after a long period of usage. As a result, the switch action may become unreliable. Furthermore, a worn down switch cannot provide the user with a good operational feeling.

Consequently, because of the above limitation resulting from the technical design of prior art, the inventor strives via real World experience and academic research to develop the present invention, which can effectively improve the limitations described above.

SUMMARY OF THE INVENTION

The object of the present invention is to provide an axially-movable rotary switch, whereby a user can switch the states between a closed circuit and an open circuit by axially drawing/pressing the knob. Thus, the operation is easy with a good feeling. Furthermore, the frictional interference will not be generated.

In order to achieve the above objects, the present invention provides an axially-movable rotary switch, which includes: a hollow casing with its upper end having an opening and its lower end having a through hole in communication with the interior of the hollow casing; a fixing base fixed in the hollow casing, the fixing base having a base hole and at least one positioning hole, the base hole and the positioning hole passing through the upper and lower surfaces of the fixing base, the positioning hole being disposed adjacent to the base hole; a substrate fixed below the fixing base, the substrate having a plate hole and at least one electrical contact; and a knob pivotally disposed on the upper end of the hollow casing, the knob having a shaft, a shaft hole, a switching rod and an elastic piece, the shaft being disposed in the center of the knob and penetrating the base hole and the plate hole, the shaft hole passing through the shaft, the switching rod being eccentrically disposed in the vicinity of the shaft and penetrating the positioning hole, the elastic piece being disposed at the distal end of the switching rod and electrically contacting the electrical contacts of the substrate.

The present invention has advantageous features as follows. Since the elastic piece of the switching rod is provided to correspond to the electrical contacts of the substrate, the user can switch the states between a closed circuit and an open circuit by axially drawing the knob relatively to the hollow casing. Thus, the operation is easy with a better feeling. Furthermore, when switching the states between a closed circuit and an open circuit, the contact between the elastic piece and the electrical contacts will not generate unnecessary frictional interference, so that the lifetime of the device can be extended.

In order to further understand the characteristics and technical contents of the present invention, a detailed description relating thereto will be made with reference to the accompanying drawings. However, the drawings are illustrative only, but not used to limit the scope of the present invention.

DETAILED DESCRIPTION OF THE PREFERRED EMBODIMENTS

Please refer to FIGS. 1 to 8. The present invention provides an axially-movable rotary switch, which includes a knob 1, a fixing base 2, a substrate 3 and a hollow casing 4.

Figure 1:
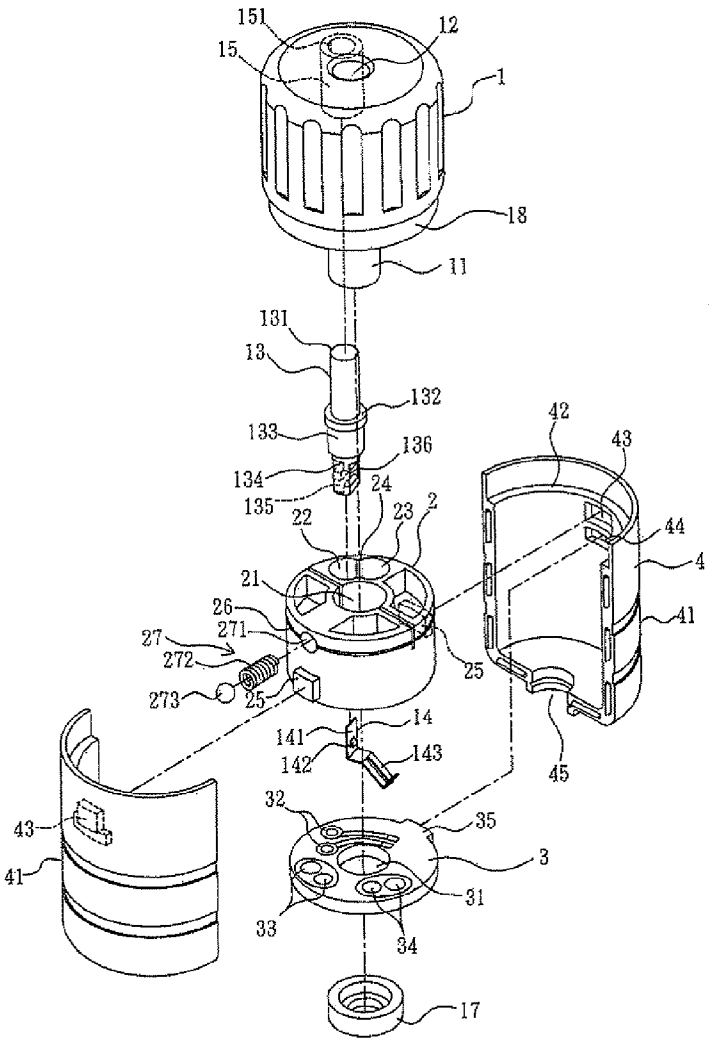
FIG. 1 is an exploded perspective view showing the axially-movable rotary switch of the present invention.
Figure 2:
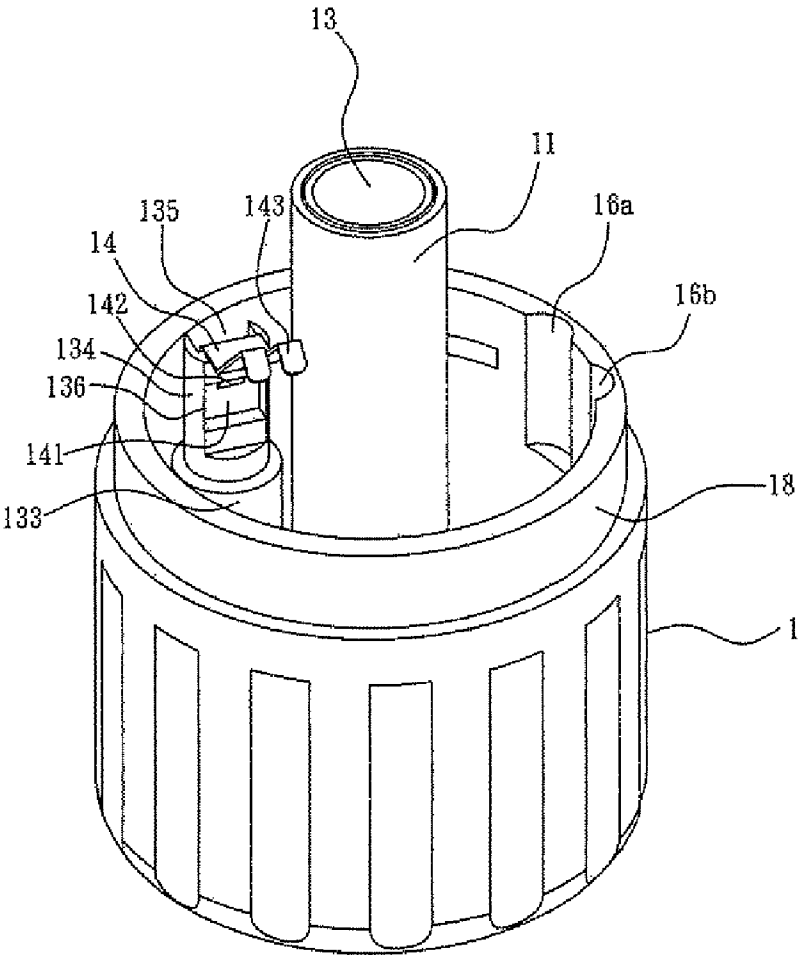
FIG. 2 is a schematic view showing the knob of the axially-movable rotary switch of the present invention from another viewing angle.

As shown in FIGS. 1 and 2, the knob 1 comprises a shaft 11, a shaft hole 12, a switching rod 13, an elastic piece 14, a connecting pipe 15, two locking grooves 16*a*, 16*b*, a end piece 17 and a stepped ring 18.

The knob 1 is a cylindrical body with an open end. The shaft 11 extends downwards from the center of the top wall of the knob 1 to the outside. The shaft hole 12 is a circular hole which passes through the shaft 11 and the shaft hole 12 penetrates through the top wall of the knob 1. A conductive line (not shown) can penetrate the shaft hole 12 to be electrically connected to electrical contacts of the substrate 3. The end piece 17 is an annular body which is fixed to the distal end of the shaft 11 for abutting the lower end surface of the fixing base 2. The stepped ring 18 is surrounding the lower end of knob 1. The stepped ring 18 can be engaged with the upper edge of a casing 4 (later described).

The connecting pipe 15 is disposed adjacent to the shaft 11 so as to be eccentrically disposed in the knob 1. The connecting pipe 15 is a hollow pipe for allowing the switching rod 13 to be inserted therein. The interior of the connecting pipe 15 has a rib 151 that is formed to correspond to a rib groove 131 (later described).

The switching rod 13 has a rib groove 131, a retaining ring 132, a post 133, a connecting tenon 134, an insertion slot 135 and a locking groove 136.

The rib groove 131 is formed by recessing the surface of the switching rod 13 to correspond to the rib 151. The retaining ring 132 is formed by surrounding the middle section of the switching rod 13. The post 133 is formed to be tightly adjacent to the retaining ring 132. The connecting tenon 134 is formed by extending downwards from the distal end of the post 133 and the connecting tenon 134 is formed on the distal end of the switching rod 13. The insertion slot 135 is formed by means of cutting longitudinally from the bottom of the connecting tenon 134 and communicates laterally with the locking groove 136. The locking groove 136 communicates laterally with the connecting tenon 134.

The switching rod 13 is inserted into the connecting pipe 15. The rib 151 is engaged with the rib groove 131, so that the switching rod 13 can be disposed in the connecting pipe 15 firmly without falling off easily. In this way, the switching rod 13 can be eccentrically disposed in the knob 1 while extending to the outside.

The elastic piece 14 has an insertion piece 141, a flange 142 and two elastic terminals 143. The elastic piece 14 is integrally formed of a conductive metal having elasticity. The insertion piece 141 is shaped as a plate. The flange 142 is formed on one side surface of the insertion piece 141. The two elastic terminals 143 are formed by extending obliquely from the distal end of the insertion piece 141.

The insertion piece 141 is disposed in the insertion slot 135 of the connecting tenon 134 (FIG. 2). The flange 142 is engaged in the locking groove 136. The elastic terminals 143 are extending obliquely from the distal end of the connecting tenon 134.

The two locking grooves 16*a*, 16*b* are formed in pairs adjacent to each other on the inner wall surface of the knob 1. The two locking grooves 16*a*, 16*b* are curved grooves disposed on the lower edge of the knob 1.

The profile of the fixing base 2 is a thick circular plate and is disposed below the knob 1. The fixing base 2 has a base hole 21, a first positioning hole 22, a second poisoning hole 23, a neck portion 24, a boss 25 and an annular rib 26.

The base hole 21 is a circular through hole corresponding to the shaft 11. The base hole 21 passes through the lower and upper end surfaces of the fixing base 2. The first positioning hole 22 and the second positioning hole 23 are disposed in the vicinity of the base hole 21. The first positioning hole 22 and the second positioning hole 23 are communicating with each other and both of them pass through the fixing base 2. The neck portion 24 is formed longitudinally at the connecting portion between the first positioning hole 22 and the second positioning hole 23.

The boss 25 is formed from the outer edge surface of the fixing base 2 to correspond to a boss hole 43 of the hollow casing 4. The annular rib 26 is surrounding the outer peripheral surface of the fixing base.

The fixing base 2 is provided with a staging means 27 including a ball hole 271, an elastic body 272 and a rolling ball 273. The ball hole 271 transversely passes through the fixing base 2. The elastic body 272 is a compression spring that is disposed in the ball hole 271. The rolling ball 273 is disposed at one end of the elastic body 272 for abutting in the locking grooves 16*a*, 16*b* of the knob 1.

The substrate 3 is disposed below the fixing base 2. The substrate 3 has a plate hole 31, at least one electrical contact and a tenon 35. The electrical contacts comprise at least one signal contact 33, at least one power contact 32, and at least one grounding contact 34. The plate hole 31 is a through hole formed corresponding to the shaft 11. The signal contact 33, the power contact 32 and the grounding contact 34 allow a lead to penetrate the shaft hole 12 to be connected thereto and are electrically connected to a power supplying device. The tenon 35 is formed by extending from the edge of the substrate 3 to correspond to a tenon hole 44 (later described).

The fixing base 2 and the substrate 3 are disposed in the hollow casing 4. The knob 1 is connected to the upper end of the hollow casing 4. The hollow casing 4 is formed by connecting two semi-circular half cylinders 41. The hollow casing 4 has a stepped groove 42, two boss holes 43, a tenon hole 44 and a through hole 45.

One end of the hollow casing 4 is an opening. The stepped groove 42 is formed by surrounding the upper edge of the hollow casing 4. The boss hole 43 is formed by recessing the inner wall surface of the hollow casing 4. The tenon hole 44 is formed below the boss hole 43. The through hole 45 is formed at the other end of the hollow casing 4 and is in communication with the interior of the hollow casing 4. An electric lead passing through the shaft hole 12 can penetrate the through hole 45.

The stepped ring 18 of the knob 1 is disposed in the stepped groove 42. Via this arrangement, the knob 1 can rotate on the upper end of the hollow casing 4. The shaft 1 penetrates the base hole 21 of the fixing base 2 and the plate hole 31 of the substrate 3. The end piece 17 disposed on the distal end of the shaft 11 can abut the lower surface of the substrate 3, thereby preventing the user from detaching the whole shaft 11 out of the substrate accidentally.

The post 133 of the switching rod 13 is inserted in the first positioning hole 22. The retaining ring 132 is disposed on an upper end of the fixing base 2. The connecting tenon 134 extends below the fixing base 2. The elastic terminals 143 of the elastic piece 14 abut one of the electrical contacts (such as power contact 32) and generate electrical connection.

The neck portion 24 between the first positioning hole 22 and the second positioning hole 23 retains the post 133 and forms an engagement there between, thereby avoiding the post 133 from moving laterally between the first positioning hole 22 and the second positioning hole 23. The boss 25 of the fixing base 2 is lodged in the boss hole 43 of the hollow casing 4. Via this arrangement, the fixing base 2 can be firmly disposed in the hollow casing 4. The tenon 35 of the substrate 3 is lodged in the tenon hole 44 of the hollow casing 4.

The annular rib 26 of the fixing base 2 abuts the inner wall of the knob 1, thereby reducing the friction and interference generated between the knob 1 and the fixing base 2 when the knob 1 rotates. The rolling ball 273 of the staging means 27 abuts in the locking groove 16*a* or 16*b* due to the pressing force of the elastic body 272. When the knob 1 rotates, the locking groove 16*a* locked with the rolling ball 273 forces the rolling ball 273 to move to another locking groove 16*b* due to the rotation, thereby generating a clear feeling in operation.

Figure 3:
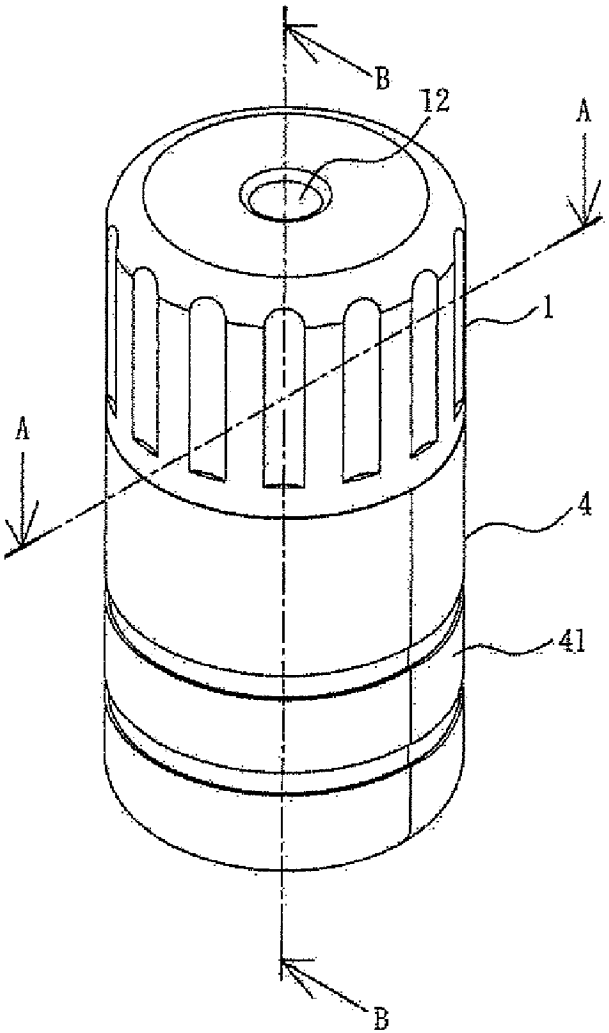
FIG. 3 is an assembled perspective view showing the axially-movable rotary switch of the present invention.
Figure 4:
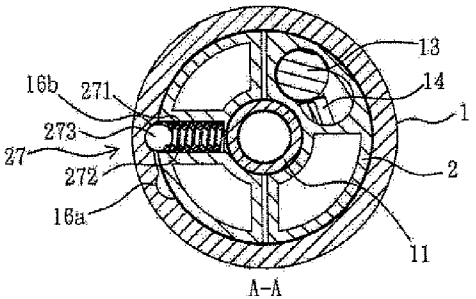
FIG. 4 is a cross-sectional view taken along the line A-A in FIG. 3.
Figure 5:
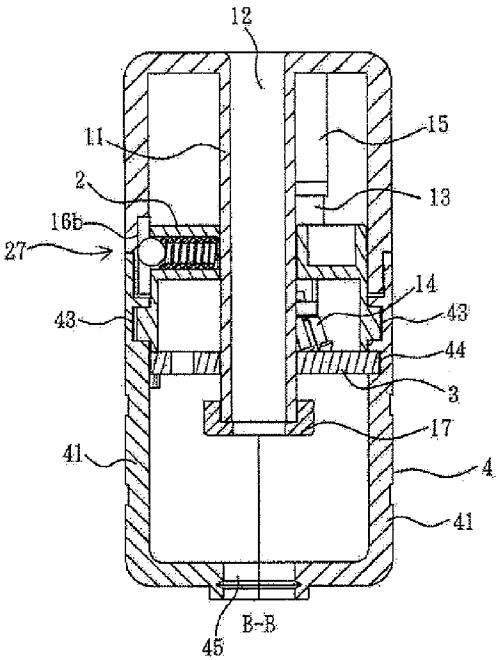
FIG. 5 is a cross-sectional view taken along the line B-B in FIG. 3.

Please refer to FIGS. 3 to 5. When the contact terminals 143 of the elastic piece 14 are brought into contact with the power contact 32 of the substrate 3, the leads passing through the axially-movable rotary switch can form a closed circuit.

Figure 6:
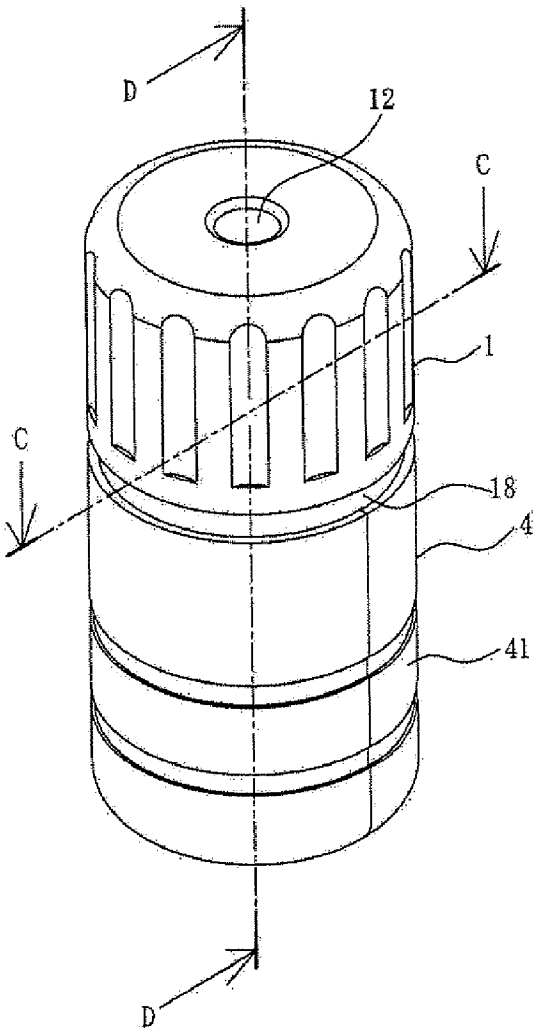
FIG. 6 is a perspective view showing a state in which the knob is drawn from the hollow casing to generate a fool-proof effect or power-switching effect.
Figure 7:
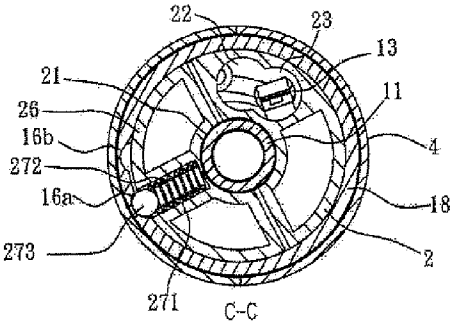
FIG. 7 is a cross-sectional view taken along the line C-C in FIG. 6.
Figure 8:
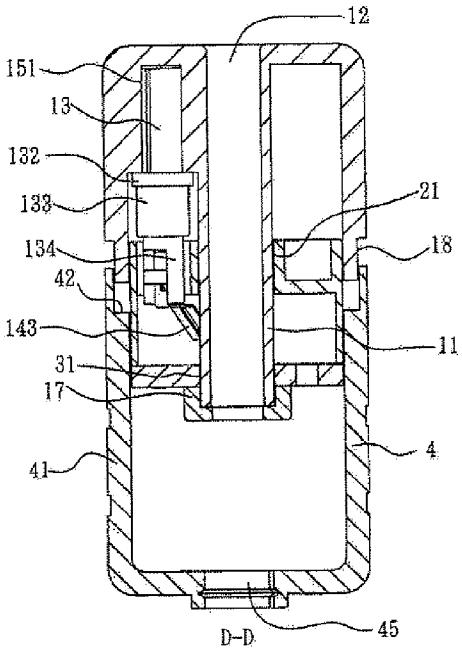
FIG. 8 is a cross-sectional view taken along the line D-D in FIG. 6.

Please refer to FIGS. 6 to 8. On the contrary, if the user intends to turn off the power supply, the user can draw the knob 1 from the hollow casing 4. At this time, the contact terminals 143 also disconnect from the power contact 32 simultaneously, so that the leads form an open circuit. In this way, the user can switch the states between a closed circuit (connecting state) and an open circuit (disconnecting state) by drawing the knob 1 or pressing the knob 1 relatively to the hollow casing 4.

Further, when the knob 1 is drawn to form an open circuit, in order to generate a fool-proof effect, the post 133 of the switching rod 13 can be moved upwards from the first positioning hole 22 to release the engagement, thereby making the connecting tenon 134 to be located in the first positioning hole 22. Then, the knob 1 is rotated to make the connecting tenon 134 to pass through the neck portion 24 between the positioning holes 22, 23 to reach the second positioning hole 23.

At the same time, after the second locking groove 16*b* is moved to the rolling ball 273 and locked therewith, the knob 1 is pushed back to make the post 133 to fall in the second positioning hole 23, thereby forming an engagement again. In this way, the fool-proof effect can be achieved. The situation that the knob 1 is pushed back by mistake to make the elastic terminals 143 to be electrically connected with the substrate 3 can be prevented reliably.

It should be understood that with a proper arrangement and connection among the signal contact 33, the power contact 32 and the grounding contact 34 of the substrate 3, the above-mentioned fool-proof effect can be replaced by a voltage-switching function while utilizing an operation substantially the same as the above. Thus, as long as the axially-movable rotary switch of the present invention is used to switch the states between a closed circuit and a open circuit by drawing the knob 1 or pressing the knob 1 relatively to the hollow casing 4. In other words, the fool-proof or the voltage-switching function can be considered as an equivalent modification of the present invention.

The present invention has features and advantages as follows.

(I) Since the knob 1 is used to switch the states between a closed circuit and an open circuit via a by drawing the knob or pressing the knob, the operation is easy with a better feeling. Furthermore, the elastic terminals 143 of the elastic piece 14 are connected to or disconnected from the substrate 3 via a vertical movement, unnecessary frictional interference can be avoided, so that the lifetime of the device can be extended.

(II) The knob 1 can make the switching rod 13 to be disposed in the second positioning hole 23 by drawing/pressing and rotating the knob. In addition to switching the states between a closed circuit and an open circuit, a fool-proof effect can be generated. Thus, the elastic terminals 143 of the elastic piece 14 can be disconnected from the power contact 32 reliably, so that the leads passing through the axially-movable rotary switch of the present invention can be switched to an open circuit reliably.

(III) As mentioned previously, with a proper arrangement among the signal contact 33, the power contact 34 and the grounding contact 35 of the substrate 3, a axially-movable rotary switch having different voltage states can be obtained.

While the present invention has been described in terms of what is presently considered to be the most practical and preferred embodiments, it is to be understood that the present invention needs not be limited to the disclosed embodiment. On the contrary, it is intended to cover various modifications and similar arrangements included within the spirit and scope of the accompanying claims which are to be accorded with the broadest interpretation so as to encompass all such modifications and similar structures.

What is claimed is:

1. An axially-movable rotary switch, comprising:

a hollow casing having an opening formed on its upper end and a through hole formed on its lower end and communicating with the interior of the hollow casing;

a fixing base fixed in the hollow casing, the fixing base having a base hole and at least one positioning hole therethrough, the positioning hole being disposed adjacent to the base hole;

a substrate fixed below the fixing base, the substrate having a plate hole and at least one electrical contact; and a knob pivotally disposed on the upper end of the hollow casing, the knob having a shaft, a shaft hole, a switching rod and an elastic piece, the shaft being disposed in the center of the knob and penetrating the base hole and the plate hole, the shaft hole passing through the shaft, the switching rod being eccentrically disposed in the vicinity of the shaft and penetrating the positioning hole, the elastic piece being disposed at the distal end of the switching rod and electrically contacting the electrical contact of the substrate.

2. The axially-movable rotary switch according to claim 1, wherein the positioning hole includes a first positioning hole and a second positioning hole, the first positioning hole and the second positioning hole are arranged to be in communication with each other.

3. The axially-movable rotary switch according to claim 2, further comprising a neck portion formed between the first positioning hole and the second positioning hole.

4. The axially-movable rotary switch according to claim 1, wherein the outer edge surface of the fixing base is formed with two bosses, the inside surface of the hollow casing has two boss holes, and the two bosses are engaged in the two boss holes respectively.

5. The axially-movable rotary switch according to claim 4, wherein the outer edge surface of the fixing base is surrounded by an annular rib, and the annular rib abuts the inside surface of the hollow casing.

6. The axially-movable rotary switch according to claim 1, wherein the fixing base further has a staging means, the staging means comprises a ball hole, an elastic body and a rolling ball, the ball hole is disposed on the outer edge surface of the fixing base, the elastic body is a compression spring, the rolling ball is disposed at one end of the elastic body, the inside surface of the knob is recessed to form two locking grooves adjacent to each other, and the rolling ball abuts one of the locking grooves.

7. The axially-movable rotary switch according to claim 1, wherein the knob further has eccentrically a connecting pipe, the connecting pipe has a rib therein, the switching rod has a rib groove, the switching rod is inserted into the connecting pipe, and the rib is disposed in the rib groove.

8. The axially-movable rotary switch according to claim 1, wherein the switching rod further has a connecting tenon on the distal end thereof, the connecting tenon has an insertion slot and a locking groove, the insertion groove is formed by longitudinally recessing the bottom of the connecting tenon, the locking groove laterally passes through the connecting tenon to be in communication with the insertion slot, the elastic piece has an insertion piece, a flange and at least one elastic terminal, the insertion piece is longitudinally inserted into the insertion slot, the flange is formed on one side surface of the insertion piece and locked in the locking groove, and the elastic terminal is formed obliquely from the distal end of the insertion piece.

9. The axially-movable rotary switch according to claim 1, wherein the shaft further has an end piece on the distal end thereof and the end piece abuts the lower surface of the substrate.

10. The axially-movable rotary switch according to claim 1, wherein the substrate further has a flat tenon, a tenon hole is formed on the inside surface of the hollow casing, and the flat tenon is disposed in the tenon hole.

11. The axially-movable rotary switch according to claim 1, wherein the substrate further has a plurality of electrical contacts, the electrical contacts comprise two power contacts, two signal contacts and two grounding contacts.

12. The axially-movable rotary switch according to claim 1, wherein the hollow casing is formed by combining two facing half cylinders together.

13. The axially-movable rotary switch according to claim 1, wherein the knob further has a stepped ring on the lower end thereof, hollow casing further has a stepped groove on the upper end thereof, and the stepped ring is disposed in the stepped groove.

* * * * *